US005803638A

United States Patent [19]

Gueret

[11] Patent Number: 5,803,638

[45] Date of Patent: Sep. 8, 1998

[54] DEVICE FOR DISPENSING A LIQUID OR PASTY PRODUCT, COMPRISING A WRINGER PART

[75] Inventor: Jean-Louis Gueret, Paris, France

[73] Assignee: L'Oreal, Paris, France

[21] Appl. No.: 606,406

[22] Filed: Feb. 23, 1996

[30] Foreign Application Priority Data

Feb. 24, 1995 [FR] France ..... 95 02197

[51] Int. Cl.[6] ..... A45D 40/00

[52] U.S. Cl. ..... 401/122; 401/129

[58] Field of Search ..... 401/122, 129

[56] References Cited

U.S. PATENT DOCUMENTS

| | | | |
|---|---|---|---|
| 185,693 | 12/1876 | Newton | 401/122 |
| 2,627,619 | 2/1953 | Gagen . | |
| 3,214,782 | 11/1965 | Masters et al. | 401/122 |
| 3,662,769 | 5/1972 | Vasas et al. . | |
| 3,896,823 | 7/1975 | Spatz . | |
| 3,921,650 | 11/1975 | Montgomery . | |
| 4,332,494 | 6/1982 | Kingsford . | |
| 4,390,298 | 6/1983 | Carluccio | 401/122 |
| 4,403,624 | 9/1983 | Montgomery | 401/122 X |
| 4,609,300 | 9/1986 | Robert | 401/122 |

FOREIGN PATENT DOCUMENTS

| | | | |
|---|---|---|---|
| 2 285 101 | 4/1976 | France . | |
| 2722232 | 11/1978 | Germany | 401/122 |
| 42 16 525 | 11/1993 | Germany . | |
| 6245813 | 9/1994 | Japan | 401/122 |

*Primary Examiner*—Steven A. Bratlie

*Attorney, Agent, or Firm*—Oblon, Spivak, McClelland, Maier & Neustadt, P.C.

[57] ABSTRACT

A device (D) for dispensing a liquid or pasty product (P) comprises a reservoir (1) of product equipped with a neck (2), and a cap (4) to close the neck of the reservoir. The cap (4) is provided with a rod (9) carrying an applicator part (7) extending into the reservoir when the cap is in the closed position. The neck (2) of the reservoir is equipped with a wringer (5) in the shape of an hourglass (10) made of a deformable elastic material through which the applicator part (7) passes as it is drawn out of the reservoir (1). The wringer (5) being designed to wipe the rod (9) and enlarge the cross-section of its opening to allow the applicator part (7) to pass through. The cross-section (S) of this applicator part being distinctly greater than that (s) of the rod (9).

17 Claims, 4 Drawing Sheets

DEVICE FOR DISPENSING A LIQUID OR PASTY PRODUCT, COMPRISING A WRINGER PART

BACKGROUND OF THE INVENTION

1. Field of the Invention

The invention relates to a device for dispensing a liquid or pasty product. This device comprises on the one hand a reservoir for the product, equipped with a neck supporting a wringer part, and on the other hand a cap to close the neck of the reservoir. This cap is provided with an applicator part which passes through the wringer part and extends into the reservoir when the cap is in the closed position.

The product to be applied may for example be a cosmetic product, in particular a make-up product such as a liquid lipstick, an eye shadow or a foundation.

With such a device, when the reservoir is closed, the applicator part can be impregnated by, for example, shaking the reservoir or turning it upside down so as to promote contact between the applicator part and the product.

The cap is then withdrawn from the reservoir so that the applicator part, impregnated with product, can be used to apply the product to the desired place (for example the lips or eyelids).

As the applicator part is drawn out it passes through the wringer part of the reservoir so that any excess product is removed from the applicator part.

2. Discussion of the Background

U.S. Pat. No. 4,332,494 and U.S. Pat. No. 3,194,848 disclose such a device for dispensing a liquid or pasty product. More precisely, the device there described is a mascara dispenser in which the wringer part is hourglass-shaped. This wringer has longitudinal slits. A device is also provided for varying the cross-section of the wringer, if desired, by compressing it in its axial direction. It is thus possible to charge the applicator part with a selectable quantity of product.

This device has the disadvantage that, because of the rigidity of the wringer part when under stress, the device cannot be used where the cross-section of the applicator part is large. The use of an applicator of small cross-section results in uneven make-up with streaks and/or splodges of product, because of the need to keep reapplying over the same area with the applicator, especially when the area to be covered is large (lips, eyelids, cheeks). Furthermore, where the applicator is a mascara brush, a wringer of this sort which is rigid and unable to expand when the brush is drawn out of the reservoir bends the bristles of the brush down on top of each other, with the consequences of not only inadequate charging of the brush but also a risk of spoiling the brush, especially over the course of many uses.

SUMMARY OF THE INVENTION

The object of the invention is to provide a device as defined above for dispensing a liquid or pasty product that does not have the above disadvantage. Hence, this device, whilst allowing the applicator part to be adequately impregnated and recharged with product before the product is applied, can be used with an applicator part of large cross-section.

The subject of the invention is therefore a device for dispensing a liquid or pasty product comprising on the one hand a product reservoir having a longitudinal axis, surmounted by a neck, and equipped with a wringer part made of an elastically deformable material, and on the other hand a cap to close the neck of the reservoir, this cap having a rod which passes through the wringer part and has on its free end an applicator part extending into the reservoir when the cap is in the closed position. This wringer part is so shaped that, as the applicator part is drawn out of the reservoir, the wringer part first wipes the rod and then is expanded by the pressure of the applicator part; the cross-section of this applicator part, measured perpendicularly to the axis, is distinctly greater than that of the rod.

The ratio of the cross-section of the applicator part to the cross-section of the rod is preferably from 4:1 to 65:1.

The wringer part advantageously includes a portion in the shape of an inner portion of a torus, its convex side facing towards the longitudinal axis of the container, that is to say towards the rod, a first end of the torus being free. The wringer part also includes a cylindrical portion of cross-section slightly greater than that of the applicator part, this cylindrical portion having means for fixing it to the neck of the container. In addition, the torus-shaped portion has a second, fixed end integral with the cylindrical portion of the wringer part.

In a first embodiment, the second, free end of the shaped torus portion points towards the reservoir.

In a second embodiment, the second, free end of the torus shaped portion points towards the neck of the reservoir.

In a plane perpendicular to the axis of the reservoir the central cross-section of the torus shaped part may have a cross-section in the shape of a ring.

In order to increase the expandability of the wringer part, the inner portion of the torus may be given at least one longitudinal slit. To this end it is also possible to provide the inner portion of the torus with a system of staggered longitudinal grooves and ribs for a concertina effect. In this case the central cross-section of the torus shaped portion, in a plane perpendicular to the axis of the reservoir, is in the shape of a star. In accordance with yet another possibility, the walls of the torus shaped portion may decrease in thickness from its extremities to its central portion. The expandability of the torus shaped portion is thus greatest in the center.

In accordance with the features described above concerning the wringer part, the pressure exerted by the applicator part on the toric inner walls of the wringer part, as the applicator part is drawn through it, includes a component normal to the axis of the reservoir. This pressure produces a lateral bulge in the toric walls of the wringer (and thus also opens any slit or slits, or stretches the concertina), followed by a gentle wringing-out of the applicator part.

The rod advantageously has a portion of reduced cross-section which, when the device is in the closed position, is situated inside the wringer part, so that no radial pressure is exerted on its walls. This feature means that the wringer part is only expanded when the extractor part is being drawn out of the reservoir.

The ability of the wringer part to expand can be obtained by using an elastomeric material selected from the group consisting of polyethylene, polyurethane and polyester elastomers; block polyether amides; polyvinyls; terpolymers of ethylene, propylene and a diene (EPDM); styrene-butadiene block polymers (SEBS-SIS), silicones and nitrile or natural rubbers.

The material used for making the wringer part is advantageously a material whose expandability is from 1% to 200%, and preferably from 20% to 100%.

The applicator part may take the form of a brush. This applicator part preferably takes the form of a tip made of an elastomeric material, for example in the form of a foam. The surface of this applicator part may be flock-coated.

The device according to the invention, described hereinabove, is especially suitable for dispensing and applying a liquid product for the lips, such as a liquid lipstick.

BRIEF DESCRIPTION OF THE DRAWINGS

Leaving aside the features described above, the invention consists of a number of other features that will be dealt with more explicitly below with regard to certain examples of embodiments thereof described with reference to the accompanying drawings, although these examples are in no sense limiting.

DESCRIPTION OF THE PREFERRED EMBODIMENTS

Figure 1A:
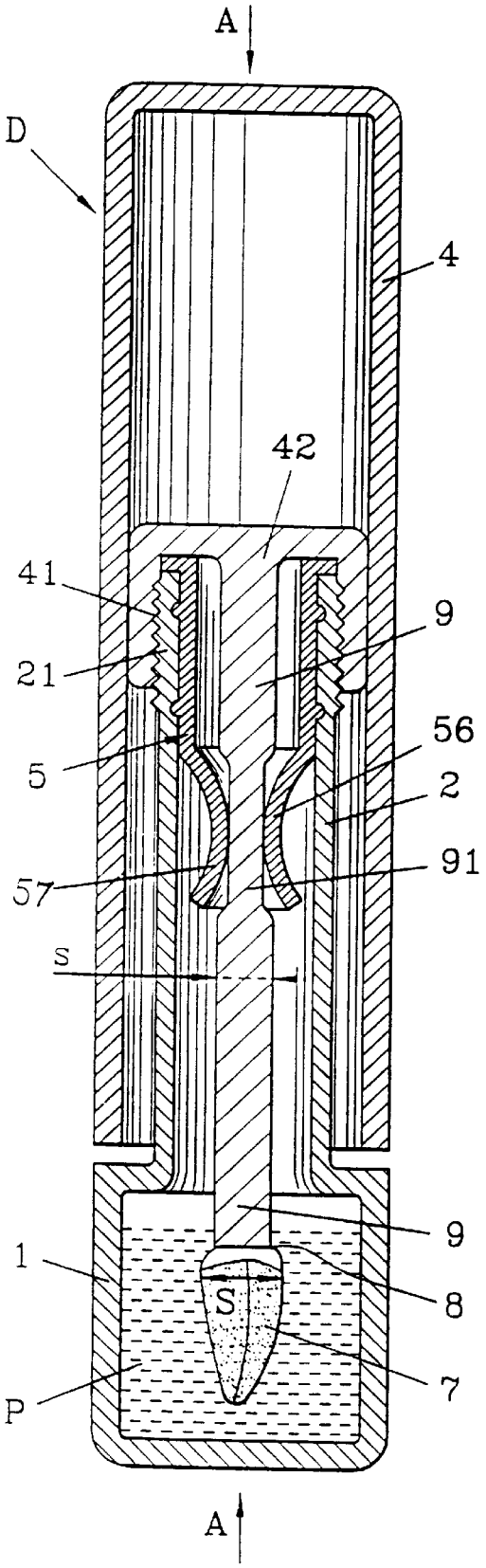
FIG. 1*a* is a longitudinal axial section through a first embodiment of a device according to the invention.
Figure 1B:
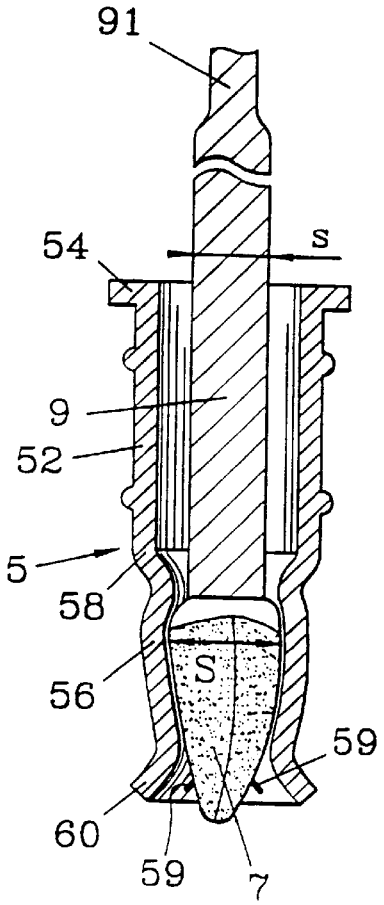
FIG. 1*b* is an enlarged view of the wringer part of FIG. 1, with the applicator part in the process of being extracted.

Referring to FIGS. 1*a* and 1*b*, these show a device D for dispensing a liquid or pasty product P, such as a liquid lipstick. This device D includes a reservoir 1, of product, which may be a bottle, such as a glass bottle, and has a relatively long neck 2 or collar with an externally threaded end 21. A cap 4 with an internal thread 41, in this case formed on an inner cap member, for mating with the threaded end 21 of the neck 2, is provided for closing the reservoir. The inner cap member shown in this case has, among other things, a transverse wall 42 which sits in a leaktight manner over the end of the neck 2. The device D has a longitudinal axis A—A.

The cap 4 is provided with an applicator part 7 or applicator tip, extending into the reservoir when the cap is in the closed position as illustrated in FIG. 1*a*.

The applicator part 7 is mounted on the bottom end 8 of a rod 9, which itself is integral with the transverse wall 42 of the cap 4 and coaxial with the cap. The rod 9 is coaxial with the neck 2 when the cap is in the closed position.

The applicator part 7 may be made of an elastomeric material, a flock-coated plastic material, felt, foam or any other equivalent material capable of absorbing the product P and suitable for applying it. The applicator part 7 may be generally spherical or ellipsoidal in shape and circular, oval or polygonal in cross-section.

The neck 2 of the reservoir is equipped with a wringer part 5 made of an elastically deformable material in which the rod 9 of the applicator part 7 sits when the cap 4 is secured to the neck 2 of the reservoir. As can be seen in FIG. 1b in particular, the wringer part 5 comprises two portions: a first, cylindrical portion forms an introductory shaft 52 fixed generally to the neck 2 of the reservoir; a second part 56 is formed by the inner portion 57 of a torus, whose convexity is turned towards the axis A—A of the reservoir. This second part is basically hourglass-shaped, with the top end 58 of the hourglass pointing towards the neck 2 and integral with the lower edge of the cylindrical shaft 52; the bottom end 60 of the hourglass, pointing towards the reservoir, is free.

The maximum cross-section S of the applicator part is generally of the same order of magnitude as that of the introductory shaft 52, and distinctly greater than the greatest diameter cross-section s of the rod 9. The maximum applicator cross-section S is also distinctly greater than the cross-section of the torus 57.

At the point where the rod 9 passes through the wringer part 5, the said rod has a region 91 of reduced cross-section so that no stress is applied by the rod to the wringer part when the device is in the rest position. The wringer part 5 has at its top end a radially outwardly projecting flange 54 forming a lip which rests axially on the end of the neck 2. This flange 54 acts as a seal.

The wringer part 5 also has at least one slit 59 running in the axial direction of the device D and closed when at rest. However, as shown in FIG. 1*b*, as the cap 4 is removed the slit or slits 59 open as the applicator part is drawn out. The walls 56 of the wringer part 57 are then subjected to radial pressure from the applicator part 7. In the example illustrated in FIGS. 1*a* and 1*b*, several slits 59 are provided at regular intervals around the axis (A—A) of the device.

In this particular example an applicator part 7 has been selected with a cross-section S of 40 $mm^2$; the cross-section of the reduced portion 91 of the rod is 7 $mm^2$; the rod 9 has a cross-section of 9 $mm^2$, and the internal cross-section of the wringer part is 10 $mm^2$. These indications are provided by way of indication and are not limiting.

The pressure exerted by the applicator part 7 on the inner walls of the wringer part 5 during extraction of the applicator part 7 includes a component normal to the axis A—A of the reservoir; the applicator part 7 has its transverse dimensions so chosen that during its passage through the wringer part this applicator part 7 produces lateral bulging of the walls 57 and opens up the slits 59 as illustrated in FIG. 1*b*.

Figure 2:
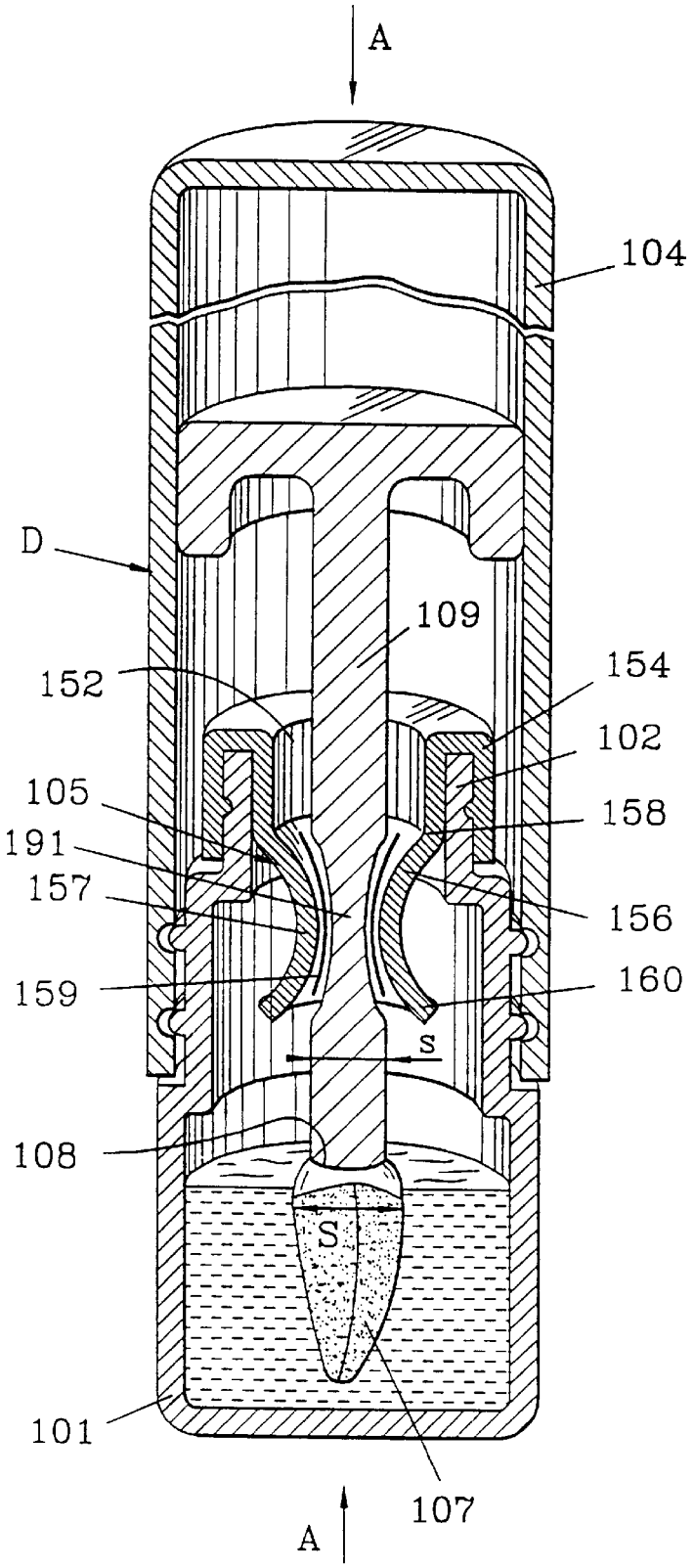
FIG. 2 is a partial view of an alternative embodiment of the device shown in FIG. 1*a;*
Figure 3:
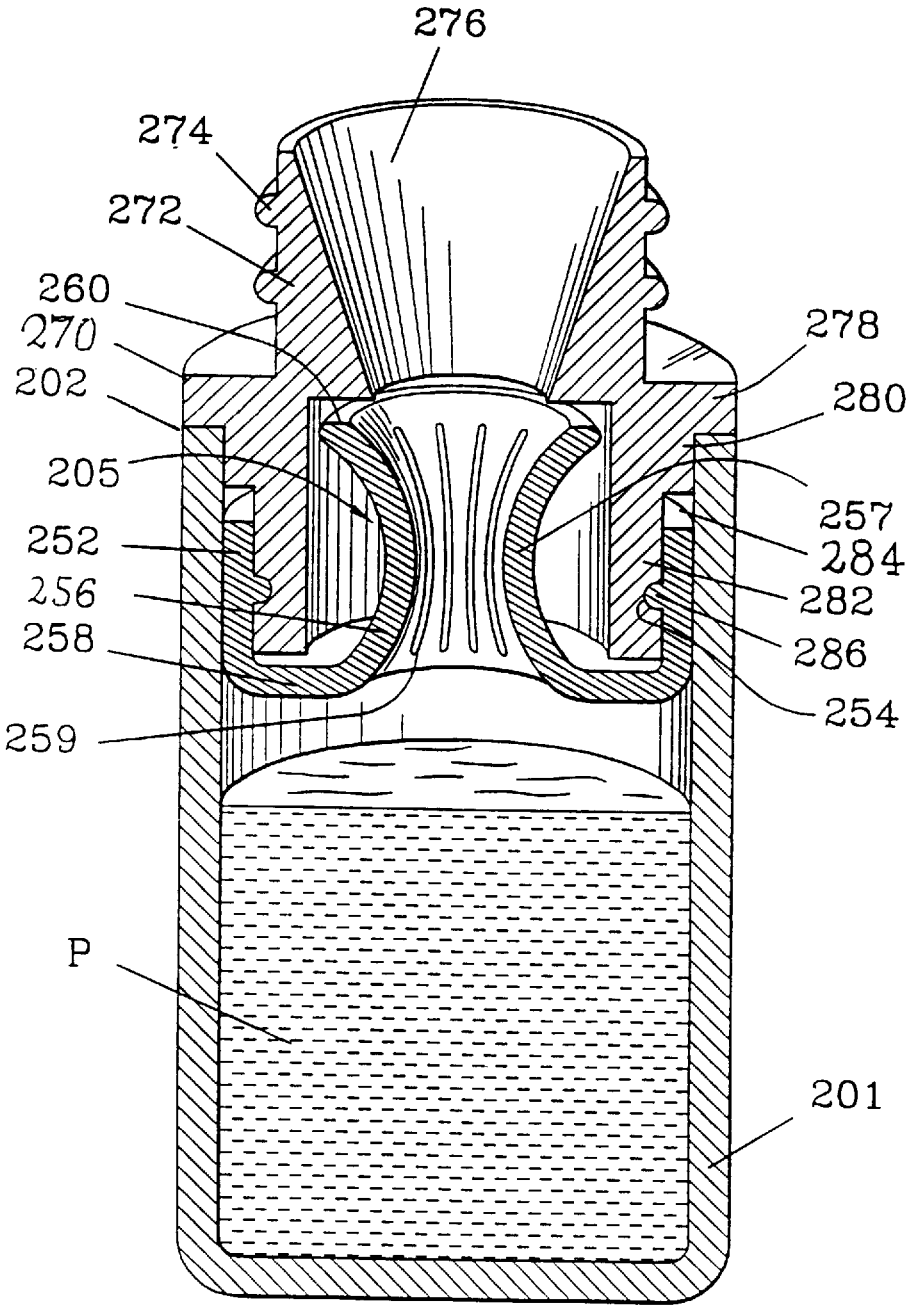
FIGS. 3 and 4 show, in cut-away perspective, other alternative embodiments of the wringer part of FIG. 1*a;*

FIGS. 2 and 3 depict alternative embodiments in which parts which are identical to, or parts serving similar functions as, the parts already described with reference to FIGS. 1*a* and 1*b* are denoted by the same reference numerals as in FIGS. 1*a* and 1*b* but increased by one hundred. The alternatives shown in the subsequent FIGS. will be treated in the same way, with a progressive increase in the hundreds figure. Parts described in relation to FIGS. 1*a* or 1*b* will only be mentioned again briefly.

Thus, FIG. 2 shows an embodiment of the device equivalent to that shown in FIG. 1, in accordance with which a wringer member 105 is provided with several longitudinal slots 159 formed in the central part of the hour glass 157. The structure of this wiping member is different from that of FIG. 1 by virtue of the presence of a fixing rim 154 bent over the open extremity of the neck 102 of the reservoir.

FIG. 3 shows an alternative embodiment in which the wringer part 205 is fixed to the reservoir 201 upside down compared with the embodiment shown in FIGS. 1*a* and 1*b*. The open end 202 of the reservoir is surmounted by a wringer holder 270 that supports, at the opposite end from the reservoir, a collar 272 having an external thread 274 designed to mate with a complementary thread on a cap (not shown). The collar 272 has a flared conical introductory shaft 276 to facilitate the insertion of the applicator part into the reservoir 201. At the opposite end from the shaft 276, the collar 272 has a radial projection 278 which rests on the open end 202 of the reservoir. In the interior of this open end, the radial projection 278 joins a cylindrical portion 280 by which the collar 272 is fixed to the reservoir. This cylindrical portion 280 is joined to a thinner cylindrical skirt 282, so that a cylindrical volume 284 is formed between the skirt 282 and the reservoir 201. A cylindrical portion 252 serving as a fastening ring for a wringer part 205 is positioned in this volume and is joined integrally to the wringer part 205.

This fastening ring 252 is held tightly in place around the skirt 282 by means of a detent system comprising an annular groove 254 and an annular bead 286. At its end nearest the reservoir, the ring 252 is integral with a washer 258 (also belonging to the wringer part 205) which in turn supports a component 257 in the shape of a portion of a torus or hourglass, the hourglass pointing towards the introductory shaft 276. The free end 260 of the hourglass has approximately the same aperture as the neighbouring portion of the introductory shaft.

The central portion of the hourglass 257 has a series of longitudinal slits 259 at regular intervals.

Figure 4:
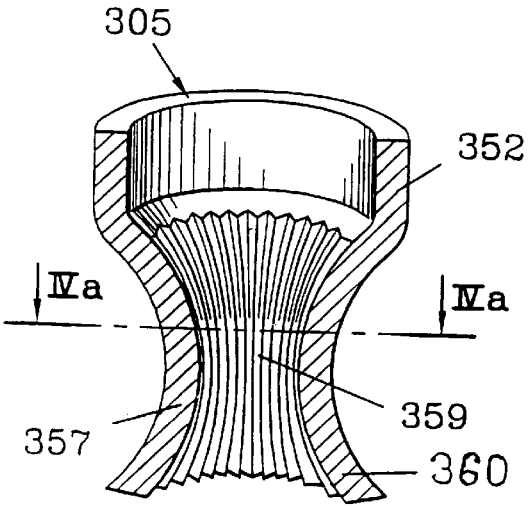

FIG. 4 shows an alternative wringer part 305 that works in much the same way as that depicted in FIG. 1*a*. This wringer part 305 has a cylindrical introductory shaft 352 that, at its end nearer the reservoir, joins an hourglass-shaped part 357. This part 357 is given longitudinal ribs 359 in its internal portion such that, in a section on the plane IVa—IVa as depicted in FIG. 4*a*, this component forms a ring having a star-shaped interior.

Figure 4A:
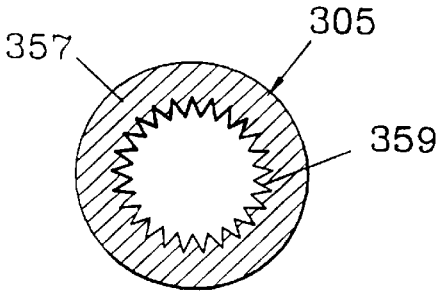
FIG. 4*a* is a section on the plane marked IVa—IVa in FIG. 4.
Figure 4B:
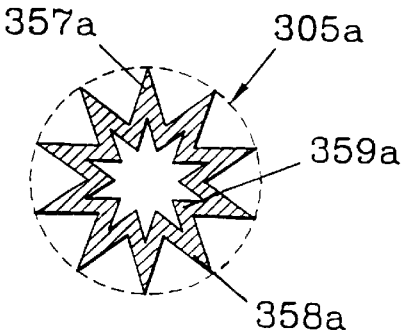
FIG. 4*b* is an alternative embodiment viewed as a section on the plane marked IVa—IVa in FIG. 4.

In another alternative, illustrated in FIG. 4*b*, which otherwise corresponds to FIG. 4*a*, the hourglass 357 is designed in the form of an annular concertina 357*a* with alternating internal ribs 359*a* and external ribs 358*a*. This structure gives the wringer part an especially great ability to expand when the applicator part is passed through it. This structure thus allows the use of applicator parts of even greater dimension than the previous structures.

Figure 5:
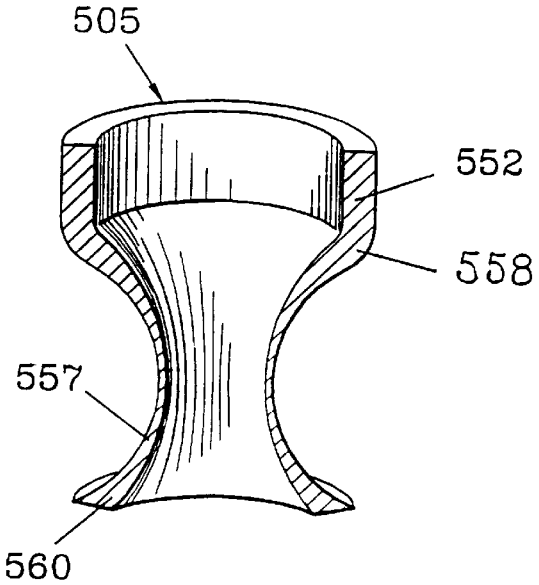
FIG. 5 shows, in cut-away perspective, another alternative embodiment of the wringer part of FIG. 1*a*.

FIG. 5 shows a wringer part 505 composed of a cylindrical introductory shaft 552 whose end 558 pointing towards the reservoir joins an hourglass-shaped part 557, the thickness of the walls of which decrease progressively from its fixed end 558 and free end 560 towards its central portion. The expandability of this part 505 when the applicator part is passed through it, is similar to that of the previous example.

What is claimed as new and is desired to be secured by Letters Patent of the United States is:

1. A device for dispensing a liquid or pasty product, comprising a product reservoir having a longitudinal axis surmounted by a neck and provided with a wringer part made of a resiliently deformable material; and a cap to close the neck of the reservoir, the cap having a rod passing through the wringer part, one end of the rod being provided with an applicator part extending into the reservoir when the cap is in the closed position;

the wringer part being so shaped that during the extraction of the applicator part out of the reservoir, the wringer part first wipes the rod and is subsequently expanded under the pressure of the applicator part, the applicator part having a cross-section (S) measured perpendicularly to the longitudinal axis that is distinctly greater than that (s) of the rod; wherein in the wringer part has a portion in the shape of an inner portion of a torus whose convexity is turned towards the longitudinal axis of the reservoir and with one end of the torus being free.

2. A device according to claim 1 wherein the wringer part includes a cylindrical portion of cross-section slightly greater than that (S) of the applicator part the cylindrical portion being connected to the neck of the reservoir.

3. A device according to claim 2, wherein the portion in the shape of a torus has a first end integral with the cylindrical portion of the wringer part and a second end, pointing towards the reservoir, being free.

4. A device according to claim 2, wherein the portion in the shape of a torus has a first end pointing towards the reservoir and integral with the cylindrical portion of the wringer part and a second end, pointing towards the neck of the reservoir, being free.

5. A device according to claim 2, wherein the inner portion of the torus is given at least one longitudinal slit.

6. A device according to claim 2, wherein in a plane perpendicular to the longitudinal axis the torus is annular.

7. A device according to claim 2, wherein the inner portion of the torus is given at least one longitudinal rib .

8. A device according to claim 7, wherein the torus, in a plane perpendicular to the longitudinal axis, is in the shape of a star.

9. A device according to claim 1, wherein the rod has a portion of reduced cross-section which, when the device is in the closed position, is situated inside the wringer part so that no radial pressure is exerted on its walls.

10. A device according to claim 1, wherein the applicator part is a brush.

11. A device according to claim 1, wherein the applicator part is a tip made of an elastomeric material.

12. A device according to claim 11, wherein the elastomeric material is selected from foams and flock-coated elastomers.

13. A device according to claim 1, wherein the wringer part is made of a material whose expandability is from 1% to 200%.

14. A device according to claim 1, wherein the wringer part is made of a material whose expandability is from 20% to 100%.

15. A device according to claim 1, wherein the wringer part is made of an elastomeric material selected from the group consisting of polyethylene, polyurethane and polyester elastomers; block polyether amides; polyvinyls; terpolymers of ethylene, propylene and a diene (EPDM); styrene-butadiene block polymers (SEBS-SIS); silicones and nitrile or natural rubbers.

16. A device according to claim 1, wherein the product is a liquid lipstick composition.

17. A device according to claim 1 characterized in that the ratio S/s is in the range of 4:1 and 65:1.

* * * * *